US006283082B1

(12) United States Patent
Gunshore et al.

(10) Patent No.: US 6,283,082 B1
(45) Date of Patent: Sep. 4, 2001

(54) METHOD AND APPARATUS TO EXTEND THE OPERATING INTERVAL BETWEEN OIL CHANGES FOR AN INTERNAL COMBUSTION ENGINE

(75) Inventors: Paul M. Gunshore; Larry W. Ishler, both of Erie, PA (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/441,573

(22) Filed: Nov. 17, 1999

(51) Int. Cl.[7] ..... F01M 3/00
(52) U.S. Cl. ..... 123/196 S; 123/196 A
(58) Field of Search ..... 123/1 A, 196 S, 123/196 A

(56) References Cited

U.S. PATENT DOCUMENTS 4,421,078 * 12/1983 Hurner ..... 123/196 R
4,495,909 * 1/1985 Hurner ..... 123/196 R
5,353,760 * 10/1994 Zager ..... 123/196 S
5,476,073 * 12/1995 Betts ..... 123/73 AD
5,562,181 * 10/1996 Elkin et al. ..... 184/1.5
5,592,395 * 1/1997 Braun et al. ..... 702/50
5,720,249 * 2/1998 Betts et al. ..... 123/196 S
5,749,339 * 5/1998 Graham et al. ..... 123/73 AD
5,816,212 * 10/1998 Lindquist et al. ..... 123/196 R
5,964,318 10/1999 Boyle et al. .

* cited by examiner

*Primary Examiner*—Noah P. Kamen
*Assistant Examiner*—Hai Huynh
(74) *Attorney, Agent, or Firm*—Carl A. Rowold, Esq.; David G. Maire, Esq.; Beusse, Brownlee, Bowdoin & Molter, P.

(57) ABSTRACT

A method for extending the interval between lubricant changes in an internal combustion engine. A small volume of lubricant is removed from the engine at periodic intervals and combusted within the engine. Clean replacement lubricant is provided to replace the portion of the lubricant removed from the engine. A connection is provided between the lubricating circuit and the fuel supply system. The flow of lubricant through the connection may be controlled in response to the measurement of a quality perimeter of the lubricant. Replacement lubricant may be provided to the engine from an onboard storage tank.

15 Claims, 1 Drawing Sheet

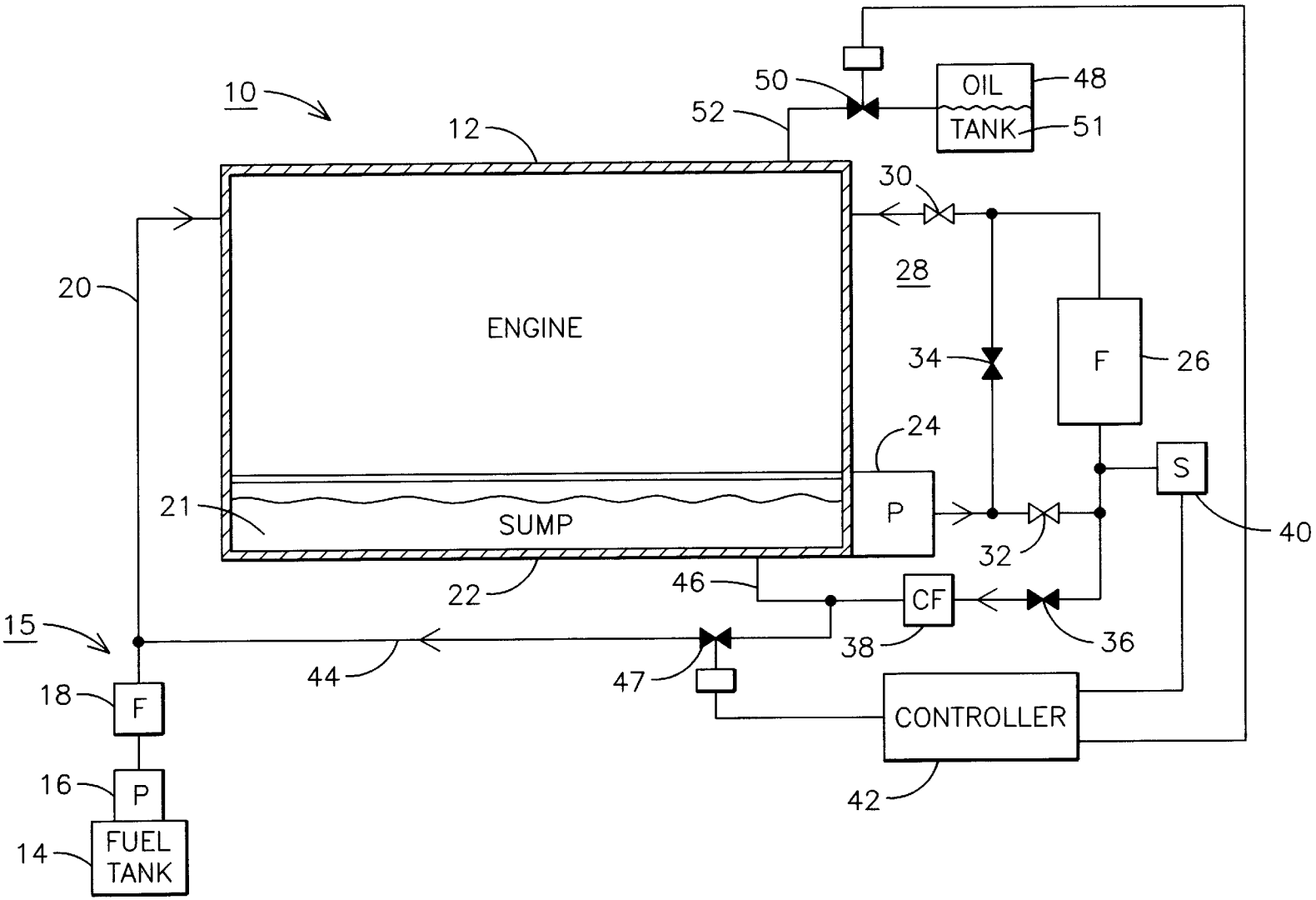
ENGINE
SUMP
OIL
TANK
F
S
P
CF
CONTROLLER
FUEL
TANK
10
12
14
15
16
18
20
21
22
24
26
28
30
32
34
36
38
40
42
44
46
47
48
50
51
52

METHOD AND APPARATUS TO EXTEND THE OPERATING INTERVAL BETWEEN OIL CHANGES FOR AN INTERNAL COMBUSTION ENGINE

BACKGROUND OF THE INVENTION

This invention relates generally to the field of internal combustion engines, and more particularly to a method and apparatus for extending the operating interval between oil changes for an internal combustion engine.

The reliability of an internal combustion engine is directly affected by the condition of the lubricant used in the engine. It is known to provide an oil filter for removing particulate matter from an engine's lubricant during the normal operation of the engine. Such oil filters must be changed regularly as they become clogged with particulate matter. Filtering of the oil is effective for removing particulate matter, however, the entire volume of the lubricant must be changed periodically in order to maintain a desired level of additives contained within the lubricant. Thus it is known that, for most internal combustion engine applications, there is a recommended frequency for changing the lubricant. For example, the manufacturers of many automobiles recommend that the lubricating oil and filter be changed after 3,000 miles of operation. The assignee of the present invention supplies locomotives driven by diesel engines. Current operating recommendations for such locomotive engines require that the engine lubricating oil be changed quarterly. An oil change on a locomotive engine requires that the locomotive to be taken out of service Thus, the interval between recommended oil changes for an internal combustion engine has an adverse impact on the overall availability of the engine for productive operation. In particular, as the reliability of locomotive components continues to increase, the engine oil change requirement may become a limiting event defining the maximum achievable on-train availability for a locomotive.

Periodic engine lubricant changes also generate a large volume of hazardous waste that must be disposed of and/or reprocessed. The operators of large fleets of internal combustion driven vehicles are faced with a considerable expense for the proper disposal of the spent crankcase oil for the entire fleet.

SUMMARY OF THE INVENTION

Thus, there is a particular need for extending the operating interval between recommended lubricant changes for an internal combustion engine. There is a further need for reducing the amount of spent lubricant that must be disposed of and/or reprocessed, and for reducing the cost associated with such disposal and reprocessing.

Disclosed herein is a method of extending the interval between lubricant changes in an internal combustion engine, the method comprising the steps of: removing from an engine a portion the lubricant in the engine; combusting the removed portion of the lubricant in the engine; and adding replacement lubricant to the engine. Also disclosed herein is a method of disposal for oil from an internal combustion engine, the method comprising the steps of: removing a portion of the oil from an internal combustion engine; mixing the portion of the oil with fuel being supplied to the engine; and combusting the portion of the oil with fuel in the engine. In a vehicle having an internal combustion engine, a fuel supply for the engine, and a lubricating circuit for supplying lubricant to the engine, an apparatus is described comprising a fluid connection between the lubricating circuit and the fuel supply, the fluid connection operable to provide lubricant from the lubricating circuit to the fuel supply for combusting in the engine.

BRIEF DESCRIPTION OF THE DRAWING

The features and advantages of the present invention will become apparent from the following detailed description of the invention when read with the accompanying drawing which is a schematic illustration of an internal combustion engine having a means for combusting a portion of the lubricating oil along with the fuel supplied to the engine.

DESCRIPTION OF THE PREFERRED EMBODIMENT

The appended FIGURE is a schematic illustration of selected systems of a vehicle 10 driven by an internal combustion engine 12. The vehicle may be, for example, a locomotive or an automobile. The engine 12 may be, for example, a gasoline or a diesel engine. The engine is supplied with fuel by a fuel supply 15 including a fuel tank 14, fuel pump 16, fuel filter 18, and fuel line 20. The moving parts of engine 12 are lubricated and cooled by a lubricant 21, such as oil, other hydrocarbon substance, synthetic lubricant, or a combination thereof. Lubricant 21 flowing out of the engine 12 is collected in a sump 22. Sump 22 may typically be a crankcase oil pan attached to engine 12. Lubricant 21 is drawn from the sump 22 by oil pump 24 for delivery through an oil filter 26 back to engine 12 in a continuous re-circulating lubricant circuit 28. The lubricating circuit 28 may also include normally open valves 30, 32 for directing the lubricant through the filter during normal operation. If the lubricating circuit 28 is provided with a back flushable filter 26, a back flushing flow of lubricant may be established by opening the normally closed valves 34, 36 and closing the normally opened valves 30, 32. In this manner, the flow of lubricant through filter 26 is reversed, thereby flushing particulate matter entrapped within filter 26 back to sump 22. In some applications, a course filter 38 may be installed in the back flushing return line 46 to prevent very large particles from re-entering sump 22 and engine 12.

A sensor 40 may be provided for measuring a quality perimeter of the lubricant. Such a quality perimeter may include, for example, the pH, the conductivity, or the opacity of the lubricant. Sensor 40 provides a signal representative of the quality perimeter to a controller 42. Controller 42 may be as simple as a display indicator for the human operator, or it may include automatic controls operable to control the position of valves 30, 32, 34, 36 for periodic back flushing of filter 26.

Also illustrated in the FIGURE is a connection 44, for example a small diameter pipe or tube, between the lubricating circuit 28 and the fuel supply 15 for the engine 12. The connection 44 is illustrated as being between the oil filter back flush return line 46 and the fuel line 20, although other embodiments may be envisioned between other points of the lubricating circuit 28 and fuel supply 15. Connection 44 is operable to remove a portion of the lubricant from the lubricating circuit 28 and to add that portion of the lubricant into the fuel being supplied to the engine 12. The initiation of the flow of lubricant through connection 44 and/or the rate of such flow may be controlled in part by the position of valve 47. In lieu of a valve 47, other means for regulating flow may be provided, such as an orifice, temporary removable connection, variable speed pump, etc. Valve 47 may be normally closed, and may be opened in response to a signal from controller 42 or by manual action of an operator.

The apparatus illustrated in the FIGURE may be utilized to operate an internal combustion engine in a manner which extends the interval between required lubricant changes. After an initial operating period following a regularly scheduled oil change, a quality perimeter may be measured for the lubricant by sensor 40. When that quality indicator reaches a predetermined value, a portion of the lubricant in the engine may be removed from the engine and combusted in the engine along with the normal fuel. Clean replacement lubricant may then be added to the engine to replace the portion of the lubricant having been removed and combusted. The FIGURE illustrates an oil tank 48 for storing replacement lubricant 51 prior to its introduction into the engine 12. In the embodiment of a locomotive engine 12, replacement oil tank 48 may be located on board the locomotive. A valve 50 in a line 52 connecting the tank 48 and the engine 12 controls the flow of replacement lubricant 51 from the tank 48 to the engine 12. Valve 50 may be operated manually, or, as illustrated in the FIGURE, by a signal produced by controller 42 in response to the removal of a portion of the lubricant from the engine 12 for combusting therein. After a subsequent period of operation of engine 12, the steps of removing a portion of lubricant from the engine, combusting the removed portion of the lubricant in the engine, and replacing the removed lubricant with replacement lubricant may be repeated. In this manner, a portion of the lubricant is replaced by fresh lubricant on a periodic basis, thereby refreshing the additives in the lubricant and eliminating a portion of the contaminants entrained therein. Such refreshing of the lubricant maintains the quality of the lubricant, thereby extending the interval between necessary lubricant changes.

The portion of the lubricant that is removed from the engine and combusted therein may be obtained from any portion of the lubricant circuit 28. Advantageously, if back flush oil flow is utilized as the source of the lubricant being combusted, a higher concentration of contaminants may be removed from the lubricant circuit 28 than would otherwise be removed by simply obtaining the portion of the lubricant from the sump 22. Most known lubricants will combust with as much energy release as would otherwise be obtained with the normal fuel supplied to the engine. For example, oil utilized in a locomotive diesel engine will combust with a higher heat output than an equivalent volume of diesel fuel. In order to insure clean combustion and to otherwise minimize the impact on the fuel supply system 15 and the engine 12, the lubricant may be mixed with the fuel at a concentration of no more than two percent lubricant by volume. Higher concentrations may be operable for certain applications. In other embodiments, the lubricant may be mixed with the fuel at a concentration of no more than one percent lubricant by volume, or between one percent and two percent by volume. The steps of removing a portion of the lubricant from the engine and combusting that portion within the engine may be accomplished during the normal operation of the engine. If a supply of replacement lubricant is available to the engine during its normal operation, such as by onboard tank 48, the step of replacing the portion of lubricant combusted in the engine may also be accomplished during normal operation of the engine.

By replenishing the beneficial additives that otherwise become depleted within the lubricant, and by removing a portion of the contaminants that may accumulate within the engine, the apparatus and method of this invention serve to extend the interval between lubricant changes in an internal combustion engine. It is expected by the inventors that for the application of a locomotive engine, the normal recommended oil change interval of three months may be extended to as much as one year or more. At full power, a locomotive may burn fuel at approximately three gallons per minute. Lubricant may be removed from the engine and supplied to the fuel supply line 20 at a rate of 0.03–0.06 gallons per minute, preferably during a period of back flushing of oil filter 26. This flow rate may be maintained for 1–1½ minutes, thereby resulting in the removal of 0.03–0.09 gallons from the engine 12 for each sequence of oil filter 26 back flushes. Such an operation may be accomplished with a frequency sufficient to remove the equivalent of the total volume of lubricant within the engine once every six months, thereby making a complete oil change necessary only once a year. Because a locomotive must be refueled every three to four days, the replacement oil tank 48 may need to be only about fifty gallons in capacity. This process is expected to provide clean incineration of the removed lubricant, and dispersion of the by-products of combustion of that lubricant over a wide geographic area. Therefore, it provides a beneficial method for disposing of spent lubricant from an internal combustion engine. No additional emissions control devices or special operating procedures are expected to be necessary to satisfy current environmental emissions regulations for the application of a locomotive engine.

While the preferred embodiments of the present invention have been shown and described herein, it will be obvious that such embodiments are provided by way of example only. Numerous variations, changes and substitutions will occur to those of skill in the art without departing from the invention herein. Accordingly, it is intended that the invention be limited only by the spirit and scope of the appended claims.

What is claimed is:

1. The method of extending the lubricant maintenance interval for an internal combustion engine, the method comprising:

continuously withdrawing a portion of the engine lubricant from the engine;

directing the withdrawn lubricant to a lubricant filter;

removing impurities from the lubricant at the filter, with the separated impurities accumulating at the filter;

returning the cleaned lubricant to the engine;

periodically washing the filter with a cleaning fluid to remove accumulated impurities; and combusting the cleaning fluid with impurities in the engine.

2. The method of claim 1 wherein the filter comprises filter media and the washing comprises flowing cleaning fluid back through the filter media to remove the impurities on the filter media.

3. The method of claim 1 wherein the cleaning fluid comprises engine lubricant.

4. The method of claim 3 wherein the cleaning fluid with impurities is delivered with fuel from a fuel tank to be burned in the engine.

5. The method of claim 4, wherein the lubricant is mixed with the fuel at a concentration not requiring additional emissions control devices or special operating procedures to satisfy emissions regulations.

6. The method of claim 5, wherein the lubricant is mixed with the fuel at a concentration of no more than 1% lubricant.

7. The method of claim 5, wherein the lubricant is mixed with the fuel at a concentration of between 1% and 2% lubricant.

8. The method of claim 1, further comprising periodically washing the filter in response to a measured quality parameter of the lubricant.

9. Apparatus for extended lubricant maintenance intervals for an internal combustion engine, the apparatus comprising:

a lubricant circuit having a sump for collecting lubricant flowing from the engine;

a pump having an inlet receiving lubricant from the sump and an outlet for delivery of lubricant back to the engine;

a filter receiving lubricant from the engine and separating impurities from the lubricant with the separated impurities accumulating in the filter;

fluid flow connection connecting the pump, filter and engine; and a filter backwash circuit for directing cleaning fluid to the filter for removing impurities accumulated at the filter and directing the cleaning fluid with impurities to the engine for combustion in the engine.

10. The apparatus of claim 9 wherein the cleaning fluid is engine lubricant.

11. The apparatus of claim 10 her comprising fluid flow connection between the filter and a fuel system for directing the lubricant with impurities backwashed from the filter to fuel for the engine.

12. The lubricating apparatus of claim 11, further comprising a flow regulator regulating the flow of lubricant through the filter and to the fuel system.

13. The lubricating apparatus of claim 12, wherein the flow regulator further comprises a sensor for measuring a quality parameter of the lubricant and a valve having a position responsive to a signal from the sensor.

14. In an engine for a vehicle having a lubricant circuit for circulating lubricant through the engine, the lubricant circuit including a filter for removing impurities from the lubricant upon circulation and for accumulating such impurities, the engine including a fuel system for providing fuel for combustion within the engine, an apparatus comprising:

a filter cleaning circuit for delivering a cleaning fluid to the filter for removing accumulated impurities from the filter; and a connection between the filter cleaning circuit and the fuel system for providing the cleaning fluid carrying the removed impurities to the fuel system for combustion within the engine.

15. The apparatus of claim 14, wherein the cleaning fluid comprises a quantity of lubricant withdrawn from the lubricant circuit, and further comprising a replacement lubricant system for providing replacement lubricant to the engine to replace the quantity of lubricant withdrawn from the lubricant circuit to serve as the cleaning fluid in the filter cleaning circuit.

* * * * *